US011933174B2

(12) United States Patent
Al-Mousa et al.

(10) Patent No.: US 11,933,174 B2
(45) Date of Patent: Mar. 19, 2024

(54) MODIFIED WHIPSTOCK DESIGN INTEGRATING CLEANOUT AND SETTING MECHANISMS

(71) Applicant: SAUDI ARABIAN OIL COMPANY, Dhahran (SA)

(72) Inventors: Ahmed Abdulaziz Al-Mousa, Dhahran (SA); Saad M. Budair, Dhahran (SA); Linlin Wang, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/652,622

(22) Filed: Feb. 25, 2022

(65) Prior Publication Data

US 2023/0272672 A1 Aug. 31, 2023

(51) Int. Cl.

| | |
|---|---|
| ***E21B 7/06*** | (2006.01) |
| ***E21B 10/26*** | (2006.01) |
| ***E21B 17/14*** | (2006.01) |
| ***E21B 29/06*** | (2006.01) |

(52) U.S. Cl.

CPC ..... *E21B 7/061* (2013.01); *E21B 10/26* (2013.01); *E21B 17/14* (2013.01); *E21B 29/06* (2013.01)

(58) Field of Classification Search

CPC ..... E21B 7/061; E21B 10/26; E21B 21/08; E21B 21/103; E21B 29/06

See application file for complete search history.

(56) References Cited

U.S. PATENT DOCUMENTS

| | | | | |
|---|---|---|---|---|
| 3,433,313 | A | 3/1969 | Brown | |
| 6,050,334 | A | 4/2000 | McGarian et al. | |
| 6,695,056 | B2 | 2/2004 | Haugen et al. | |
| 9,863,214 | B2 | 1/2018 | Cronley | |
| 2008/0185148 | A1 | 8/2008 | Carter et al. | |
| 2010/0012322 | A1* | 1/2010 | McGarian | E21B 7/061 166/298 |
| 2011/0192608 | A1* | 8/2011 | LeJeune | F16K 15/063 166/319 |
| 2017/0335647 | A1* | 11/2017 | Rodriguez | E21B 29/005 |
| 2021/0310312 | A1* | 10/2021 | Smith | E21B 10/26 |

OTHER PUBLICATIONS

Hildebrand, J. et al., "Single Trip Drilling System with an Integral Deflector Allows Reliable Curve Building in Challenging Formation", SPE-164494-MS, Paper presented at the SPE Production and Operations Symposium, Oklahoma City, Oklahoma, USA, Mar. 2013 (7 pages).

* cited by examiner

*Primary Examiner* — Robert E Fuller
*Assistant Examiner* — Lamia Quaim
(74) *Attorney, Agent, or Firm* — Osha Bergman Watanabe & Burton LLP

(57) ABSTRACT

A system includes a milling assembly with a mill bit and a drill string that mills a new wellbore section. The system further includes a whipstock assembly that is formed by a reamer shoe that reams an obstruction in a wellbore, a whipstock that deflects the milling assembly away from the wellbore, and a bypass valve mechanism that guides a fluid to circulate through the reamer shoe. Within the system, the milling assembly is fluidly connected to the whipstock assembly.

19 Claims, 10 Drawing Sheets

MODIFIED WHIPSTOCK DESIGN INTEGRATING CLEANOUT AND SETTING MECHANISMS

BACKGROUND

Porous rock formations contain hydrocarbon reservoirs below the surface of the earth, which contain hydrocarbon fluids. These hydrocarbon fluids are then extracted by production wells that are drilled into the hydrocarbon reservoirs. Production wells may be drilled vertically from the surface, deviated from vertical, or vertical to horizontal in order to access the subsurface hydrocarbon reservoirs effectively and efficiently.

A typical practice in well construction involves casing the wellbore with tubulars and cementing the tubulars in place. This isolates the well from the surrounding formations that may be prone to collapse or have undesirable hazards present, such as shallow gas. Generally, each section of the well is drilled by a mill bit that is attached to a drill string that extends from a drilling rig at surface to the bottom of the wellbore. The drill string and the mill bit are pulled out of the wellbore upon completion of drilling a section of wellbore, and a section of casing is deployed and cemented into place, creating isolation from the newly drilled formation.

Often in well construction it is necessary to alter an existing wellbore trajectory, a practice referred to as "side-tracking". Instances when side-tracking is typically utilized include, but are not limited to, failure of an existing wellbore, a need to avoid subsurface hazards (faults, shallow gas, etc.), planned multilateral wellbore wells, missed geological targets, and reuse of an existing wellbore that has depleted reservoir production. A longitudinal tubular body with an inclined plane, or "whipstock", is a device that is regularly installed to facilitate the altering of a wellbore trajectory. When deployed into the wellbore, the whipstock serves as a deflection surface or ramp to alter the trajectory of the mill bit and, thus, the wellbore.

SUMMARY

In general, in one aspect, embodiments disclosed herein relate to a system that includes a milling assembly with a mill bit and a drill string that mill a new wellbore section. The system further includes a whipstock assembly that is formed by a reamer shoe that reams an obstruction in a wellbore, a whipstock that deflects the milling assembly away from the wellbore, and a bypass valve mechanism that guides a fluid to circulate through the reamer shoe. Within the system, the milling assembly is fluidly connected to the whipstock assembly.

In general, in one aspect, embodiments disclosed herein relate to a method that includes running a whipstock assembly that is fluidly connected to a milling assembly into a wellbore to a desired depth. A fluid is controlled and guided by a bypass valve mechanism of the whipstock assembly to circulate through the whipstock assembly. The method further includes reaming an obstruction in the wellbore with a reamer shoe of a whipstock assembly. A whipstock of the whipstock assembly is then used to deflect the milling assembly away from the wellbore, and the milling assembly mills a new wellbore section away from the wellbore.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

Figure 1:
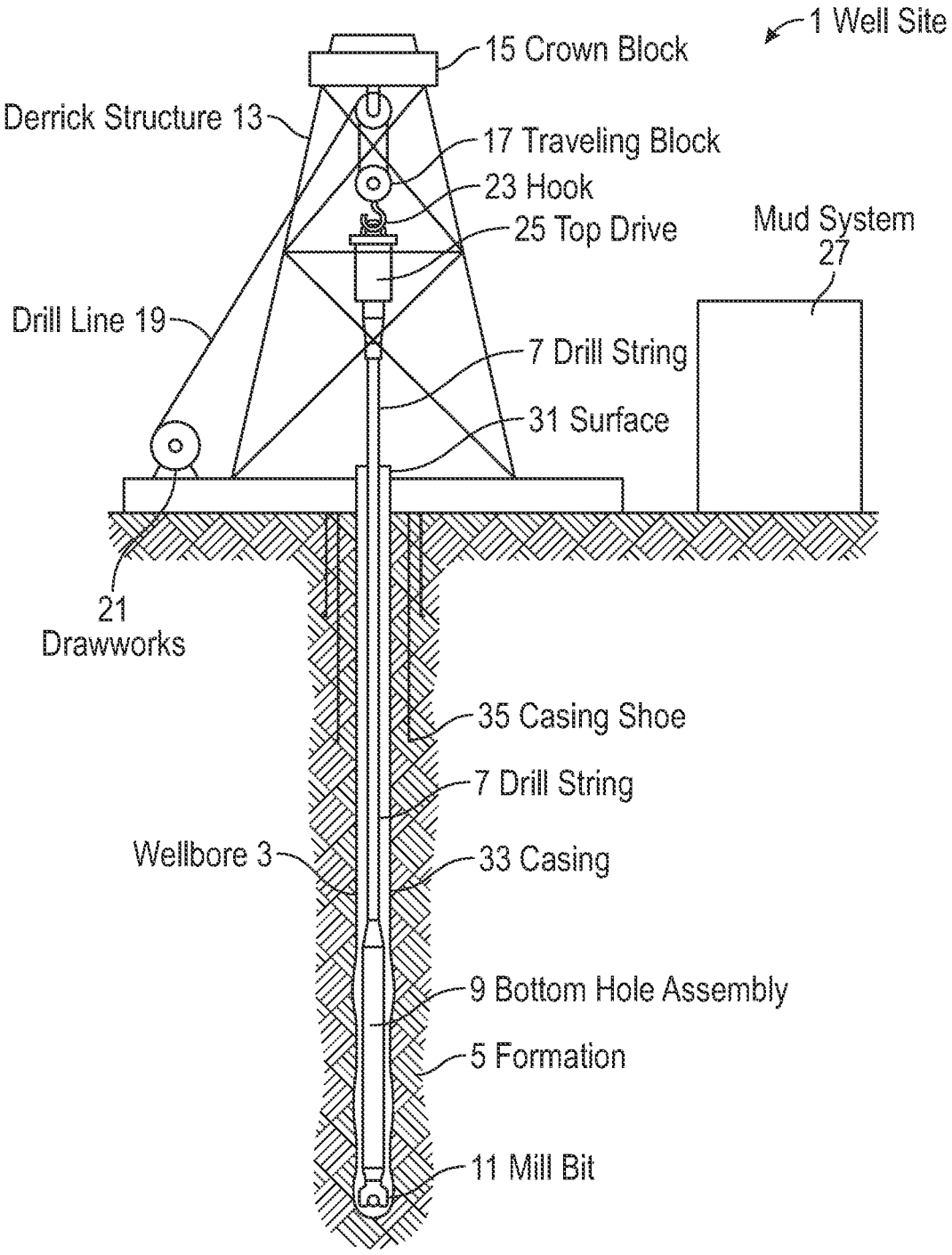
FIG. 1 illustrates an example drilling rig and wellbore in accordance with one or more embodiments of the present disclosure.

Specific embodiments of the disclosure will now be described in detail with reference to the accompanying figures. In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In addition, throughout the application, the terms "upper" and "lower" may be used to describe the position of an element in a well. In this respect, the term "upper" denotes an element disposed closer to the surface of the Earth than a corresponding "lower" element when in a downhole position, while the term "lower" conversely describes an element disposed further away from the surface of the well than a corresponding "upper" element. Likewise, the term "axial" refers to an orientation substantially parallel to the well, while the term "radial" refers to an orientation orthogonal to the well.

As is commonly known in the art, whipstock assemblies are run downhole by a drill string in a cased wellbore. However, in some cases, the well contains an obstruction in the form of a cement plug, debris, the bottom of the wellbore, or another obstruction, which are often met prior to the whipstock assembly reaching its predetermined setting depth. In such instances, in order for the whipstock to reach the desired depth, the whipstock must be removed from the wellbore and one or more costly and time consuming clean out trips are made by a bottom hole assembly (BHA) to clear out the obstructions.

Accordingly, embodiments disclosed herein describe a whipstock assembly, temporarily connected to a milling assembly, disposed at a downhole end of a wellbore at a wellsite. The new whipstock assembly system is able to ream through any obstruction while retaining the whipstock so that one or more dedicated clean out reaming trips may be avoided, thereby saving time and costs. In general, the whipstock assembly is formed from two portions: a lower portion and an upper portion. The lower portion includes a bypass valve mechanism, a turbine, and a reamer shoe. The bypass valve mechanism controls and guides a fluid pumped into the whipstock assembly from a surface of the wellbore by a variable control pressure nozzle. The bypass valve mechanism is attached at its lower end to the turbine. The bypass valve mechanism includes a plurality of valve openings at its lower end that are fluidly connected to the turbine. In addition, the bypass valve mechanism further includes a gate that is lowered by a pressure drop within the bypass valve mechanism. With the gate in an open position, the fluid passes from the bypass valve mechanism into the turbine through the plurality of valve openings, rotationally actuating the turbine by applying force upon a blade of the turbine.

The turbine is attached to the reamer shoe by a turbine output shaft. The turbine output shaft rotates with the turbine, and in turn, forces the reamer shoe to also rotate. The reamer shoe includes a plurality of flow ports and a convex shaped nose formed of bonded polycrystalline diamond (PDC), tungsten carbide, or steel. The flow ports allow the fluid to exit the system and enter the wellbore. Because the reamer shoe is situated on an obstruction at the bottom end of the wellbore, as it rotates, the reamer shoe reams the obstruction until a desired setting depth is met. Once the desired setting depth is reached, the variable control pressure nozzle reduces the pressure of the fluid. The variable control pressure nozzle is capable of adjusting the pressure of the fluid according to a size of the whipstock, a flow rate, and a fluid density.

The upper portion of the whipstock assembly includes a whipstock, an anchor connection, a whipstock anchor, a whipstock packer, and a piston. When a pressure measurement of the fluid falls below a specified requirement, the gate closes the plurality of valve openings of the bypass valve mechanism, thereby creating a pressure reaction on the piston. The piston is connected to the whipstock anchor and the whipstock packer, and when the pressure reaction applies force to the piston, the piston causes the whipstock packer to set and the whipstock packer to expand. The whipstock anchor sets by digging into the casing of the wellbore, and the whipstock packer expands in the wellbore until it reaches the casing, forming a seal within the wellbore.

In one or more embodiments, the milling assembly of the system is used to ream a new wellbore section. Prior to detaching from the whipstock assembly, the milling assembly is connected to the whipstock by a shear bolt. Upon reaching the desired setting depth and subsequent to setting the whipstock, a downward force is applied by the drill string, the shear bolt shears, detaching the milling assembly from the whipstock assembly.

In one or more embodiments, the milling assembly includes a drill string, a coupling, a stabilizer, and a mill bit, whereby each of which aid in milling a new wellbore section. The drill string of the milling assembly is a conduit, formed of several steel pipes, joined together by a coupling. The stabilizer is disposed on the drill string above the mill bit and is designed to minimize torque and drag on the drill string while milling. The stabilizer includes multiple spiral ribs constructed of high-strength alloy steel. The mill bit is commonly formed of tungsten carbide, steel, or PDC, and is designed to mill through the formation or elements within the wellbore, such as the casing or whipstock.

Once detached from the whipstock assembly, the milling assembly rotates and lowers deeper into the wellbore. As the milling assembly lowers, its trajectory is guided by the whipstock, and more specifically by a deflection surface of the whipstock. The deflection surface is utilized to deflect the milling assembly away from the wellbore to mill the new wellbore parallel to the deflection surface. Therefore, as the milling assembly mills in the direction set by the deflection surface, the milling assembly mills through the casing and into the formation until a desired location is reached. The desired location is determined prior to drilling.

FIG. 1 illustrates an example of a well site 1. In general, well sites 1 have numerous different configurations. Therefore, the well site 1 is not intended to be limited with respect to the particular configuration of the drilling equipment depicted in FIG. 1. The well site 1 is shown as being on land. In other examples, the well site 1 could be shown as being offshore with the drilling being carried out with or without use of a marine riser. A drilling operation at a well site 1 includes drilling a wellbore 3 into a subsurface of various formations 5. In order to drill a new section of wellbore 3, a drill string 7 is suspended within the wellbore 3. The drill string 7 includes one or more drill pipes connected to form a conduit, and a BHA 9 disposed at the distal end of the conduit. For cutting into the subsurface rock, a mill bit 11 is utilized as a part of the BHA 9. Further, the BHA 9 includes measurement tools, such as a measurement-while-drilling (MWD) tool or a logging-while-drilling (LWD) tool, as well as other drilling tools that are not specifically shown but would be understood to a person skilled in the art.

A derrick structure 13 is used to suspend the drill string 7 in the wellbore 3. The top of the derrick structure 13 is mounted with a crown block 15. From the crown block 15, a traveling block 17 hangs down by means of a cable or drill line 19. One end of the drill line 19 is connected to a drawworks 21, which is a reeling device that adjusts the length of the drill line 19 so that the traveling block 17 is capable of moving up or down the derrick structure 13. The traveling block 17 includes a hook 23 that supports a top drive 25. The top drive 25 is coupled to the top of the drill string 7 and is operable to rotate the drill string 7. The drill string 7 is pumped with drilling fluid (commonly called mud) from a mud system 27. The mud flows into the drill string 7 through appropriate flow paths in the top drive 25. Details of the mud flow path have been omitted for simplicity but would be understood by a person skilled in the art.

During a drilling operation at the well site 1, in order to break rock, the drill string 7 is rotated relative to the wellbore 3 and weight is applied to the mill bit 11. In some cases, the mill bit 11 is rotated independently with a drilling motor. In other embodiments, the mill bit 11 is rotated using a combination of a drilling motor and the top drive 25 to rotate the drill string 7. Mud is pumped into the drill string 7 while the mill bit 11 cuts through the rock. The mud flows down the drill string 7 and exits through a nozzle in the mill bit 11 into the bottom of the wellbore 3. Once in the wellbore 3, the mud flows back up to a surface 31 in an annular space between the drill string 7 and the wellbore 3 carrying entrained cuttings to the surface 31. The mud with the cuttings is returned to the mud system 27 to be circulated back again into the drill string 7. Before pumping the mud again into the drill string 7, the cuttings are typically removed from the mud, and the mud is reconditioned as necessary.

Upon the retrieval of the drill string 7, the BHA 9, and the mill bit 11 from the wellbore 3, the drilling operations are complete. Alternatively, the production casing operations commence in some embodiments of wellbore 3 construction. In such instances, a casing 33 made up of one or more larger diameter tubulars that have a larger inner diameter than the drill string 7 but a smaller outer diameter than the wellbore 3 is lowered into the wellbore 3 on the drill string 7. The casing 33 is designed to isolate the internal diameter of the wellbore 3 from the adjacent formation 5. Once the casing 33 is positioned, it is set and cement is pumped down through the internal space of the casing 33, out of the bottom of a casing shoe 35, and into the annular space between the wellbore 3 and the outer diameter of the casing 33. This creates the desired isolation between the wellbore 3 and the formation 5 and secures the casing 33 in place. Afterwards, the drilling of the next section of the wellbore 3 begins.

A whipstock 37 is deployed when there is a need to alter the trajectory of the wellbore 3. In one or more embodiments a whipstock 37 includes a lower anchoring mechanism, an inclined deflection surface 39, and a releasable connection to a milling assembly 41 located at the top of the whipstock 37. The lower anchoring mechanism may be a hydraulic or mechanical anchor configured to be removable following a drilling operation, while the releasable connection may be a shear bolt 43 or an equivalent shearing connection. The whipstock 37 and the milling assembly 41 are deployed into the wellbore 3 as an assembly during whipstock operations. The anchoring mechanism is activated and attaches the whipstock 37 to the inside surface of the casing 33 once the setting depth is reached.

Afterwards, a downward force to the whipstock 37 is applied from the drill string 7, severing the releasable connection, thereby releasing the milling assembly 41 and the mill bit 11 from the whipstock 37. Alternatively, the whipstock 37 is anchored in the wellbore 3 without being attached to the milling assembly 41 if the whipstock 37 is deployed in the wellbore 3 by a separate running tool. In either configuration, once placed, the whipstock 37 is anchored in the wellbore 3 independent of the milling assembly 41 such that the milling assembly 41 moves freely within the wellbore 3. As the mill bit 11 begins drilling, the deflection surface 39 of the whipstock 37 is used as a guide to deflect the mill bit 11 away from the existing wellbore 3 to begin drilling a new wellbore 45 of a different trajectory.

Figure 2:
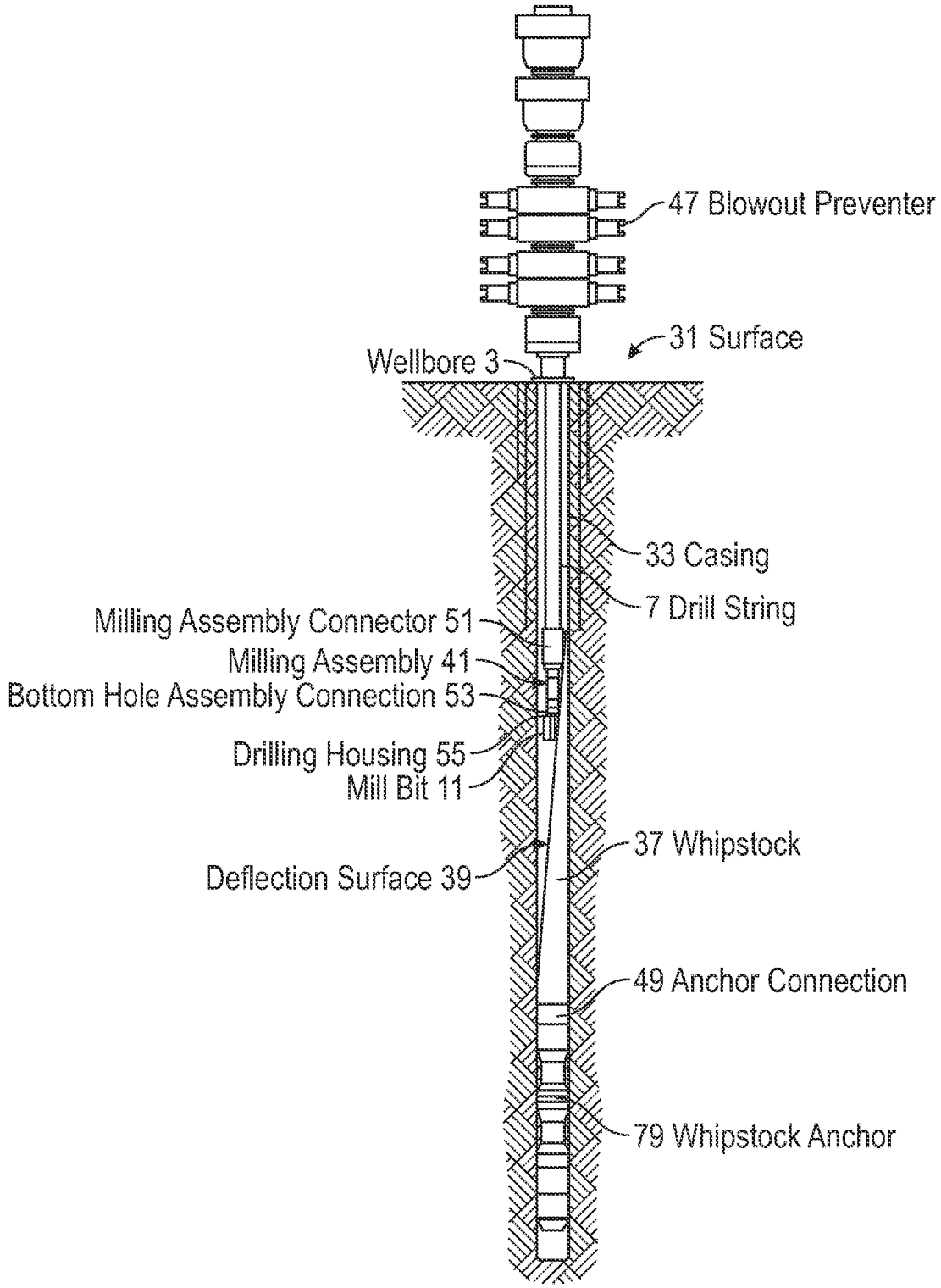
FIGS. 2 and 3 show diagrams depicting the operational sequence of setting a whipstock in accordance with one or more embodiments of the present disclosure.
Figure 3:
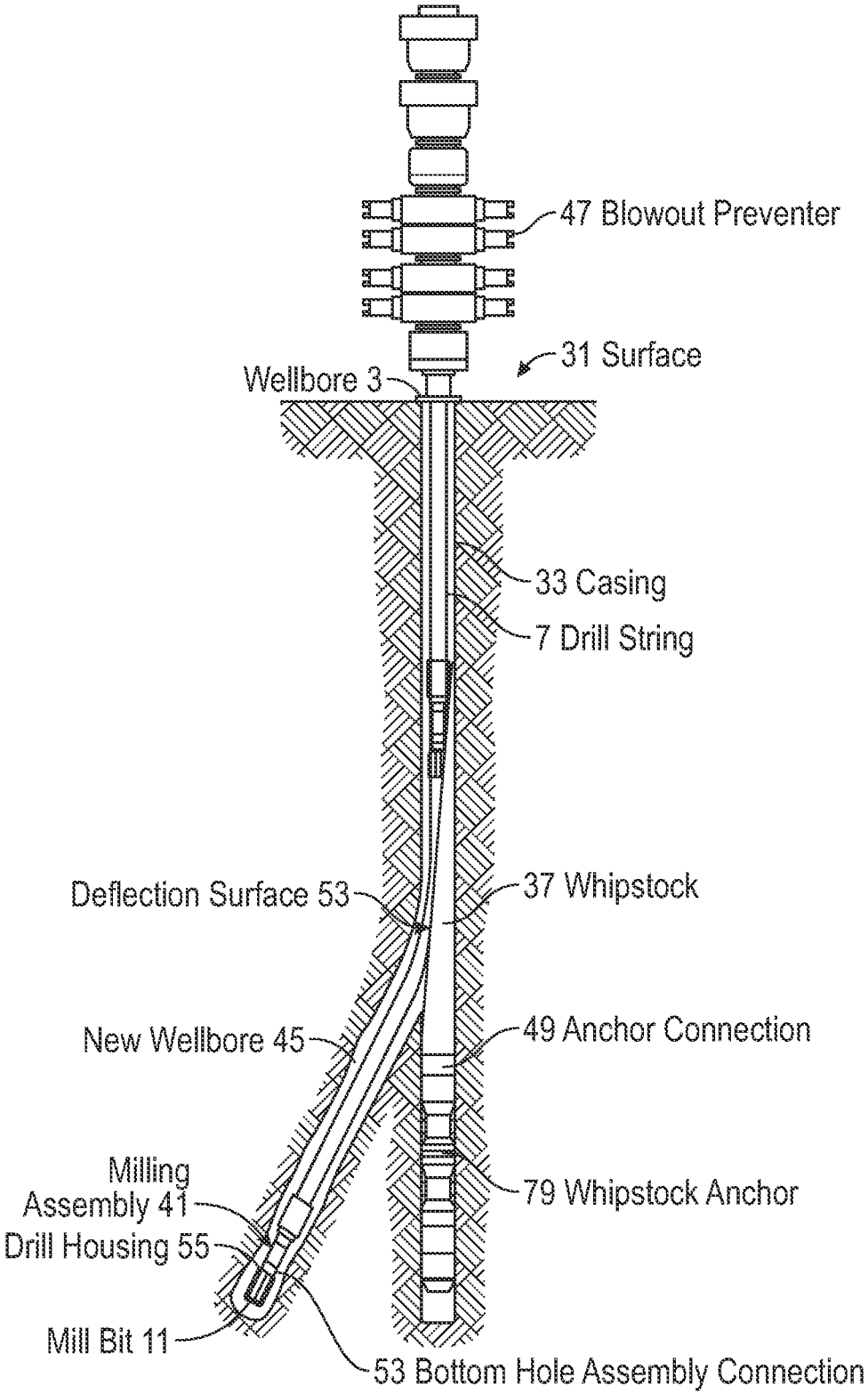

FIGS. 2 and 3 provide an overview of an operational sequence of setting a common whipstock 37 in accordance with embodiments disclosed herein. FIG. 2 illustrates a whipstock 37 that has been deployed on a drill string 7 and anchored to the casing 33 of the wellbore 3. The wellbore 3 includes an installed Blowout Preventer (BOP) 47. The BOP 47 is installed during whipstock operations while drilling a new wellbore 45 section and is considered safety critical equipment. The whipstock 37 includes a deflection surface 39 and a connection to an anchor via an anchor connection 49. The deflection surface 39 is an inclined, concave-shaped bar used to deflect a mill bit 11.

The mill bit 11 is designed for milling through metal or steel and is a fixed-style bit. Generally, in the oil and gas industry, when there is a need to 'sidetrack' or change the trajectory of a wellbore 3, this type of mill bit 11 is utilized to mill a window in the casing 33. The mill bit 11 is typically formed from tungsten carbide; however, one of ordinary skill in the art would appreciate that the mill bit 11 may be formed from steel, a high strength alloy, or equivalent, and may further be coated with a PDC layer.

Further, FIG. 2 depicts a milling assembly 41 that is attached to the whipstock 37 by a milling assembly connector 51. The milling assembly 41 includes a BHA connection 53, a drilling housing 55, and the mill bit 11. The milling assembly connector 51 is a force-limiting type connection that is designed to fail upon the application of a predetermined amount of applied force, such as a shear bolt 43, magnetic interlock, or other equivalent connection known to one of ordinary skill in the art. Alternatively, and as described above, the whipstock 37 is deployed in the wellbore 3 prior to a drilling operation by a separate running tool or assembly. Once the whipstock 37 is deployed, the running tool or assembly is removed from the wellbore 3 before the drilling operation begins.

FIG. 3 shows the milling operations of a new section of the wellbore 3. The milling assembly connector 51 of FIG. 2 is sheared by applying a downward force to release the milling assembly 41 from the anchored whipstock 37. This milling assembly connector 51 may be a shear bolt 43 or another suitable shearing device. The mill bit 11 is then redirected by the deflection surface 39 of the whipstock 37 and begins to mill a window in the casing 33, departing from the wellbore 3 and re-orienting the trajectory of the wellbore 3 into the new wellbore 45.

Figure 4:
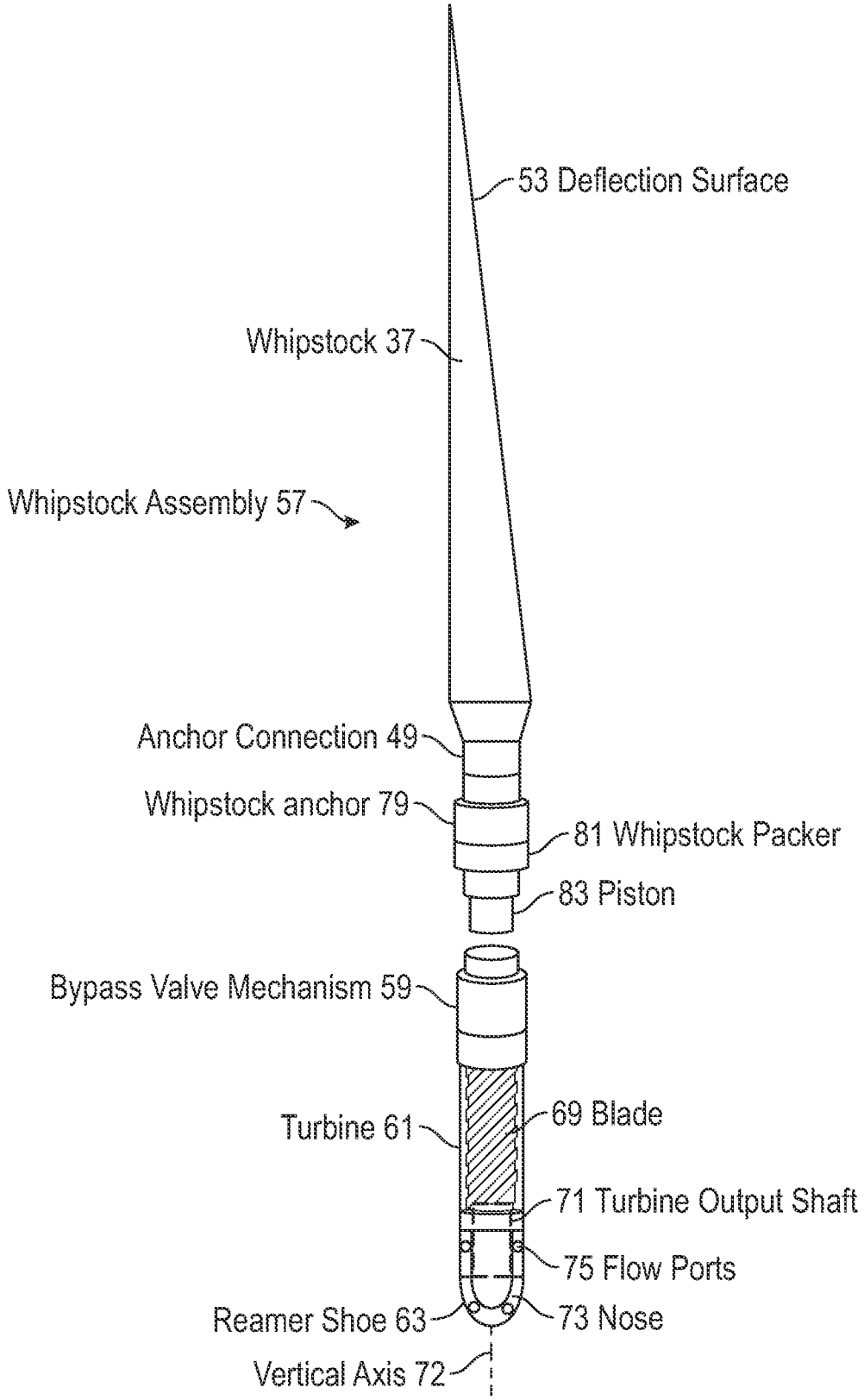
FIG. 4 shows a whipstock assembly in accordance with one or more embodiments of the present disclosure.

FIG. 4 illustrates a whipstock assembly 57 according to one or more embodiments, separated into the two sections: a lower portion and an upper portion. The lower portion includes a bypass valve mechanism 59, a turbine 61, and a reamer shoe 63. The bypass valve mechanism 59, formed of steel, is disposed at an upper end of the lower portion of the whipstock assembly 57. Disposed at an upper end of the bypass valve mechanism 59 is an opening that is connected to and receives fluid from the upper portion of the whipstock assembly 57. A plurality of valve openings 65 are situated at a lower end of the bypass valve mechanism 59. The fluid enters the bypass valve mechanism 59 through the opening and exits through the plurality of valve openings 65 if a gate 67 of the bypass valve mechanism 59 is in the open position. The structure of the bypass valve mechanism 59 is further detailed in FIGS. 5 and 6, which show the bypass valve mechanism 59 with the gate 67 in an open position and closed position, respectively, in accordance with one or more embodiments of the present disclosure.

Upon exiting the bypass valve mechanism 59, the fluid enters the turbine 61 of the lower portion of the whipstock assembly 57. The turbine 61 is situated between the bypass valve mechanism 59 and the reamer shoe 63 and contains a helically shaped steel blade 69. Additionally, the turbine 61 may include helically shaped lobes or a plurality of blades rather than a helical blade 69. Regardless of the structure thereof, the blade 69 rotates under the force generated by the fluid passing over it. As the blade 69 rotates, it forces a turbine output shaft 71 of the turbine 61 to rotate as well. The turbine output shaft 71 is formed of steel and connects the turbine 61 and the reamer shoe 63, such that the reamer shoe 63 rotates with the turbine 61. Further, the bypass valve mechanism 59, the turbine 61, the turbine output shaft 71, and the reamer shoe 63 are sequentially aligned on a same vertical axis 72.

The reamer shoe 63 is disposed at the lower end of the lower portion of the whipstock assembly 57 and is made up of a PDC nose 73 and a plurality of flow ports 75. The nose 73 is convex shaped with ledge riding capabilities and is employed to ream through an obstruction 77 at the bottom end of the wellbore 3. The obstruction 77 may be created by sloughing of a wall of the wellbore 3 or as a result of the casing 33 pushing debris ahead of the bottom end of the casing 33 along the wellbore 3 until it forms a bridge. Further, the fluid from the turbine 61 enters the reamer shoe 63 through an opening situated at a top end of the reamer shoe 63 and exits the reamer shoe 63 into the wellbore 3 through the flow ports 75 of the reamer shoe 63.

The upper portion of the whipstock assembly 57 is composed of a whipstock 37, an anchor connection 49, a whipstock anchor 79, a whipstock packer 81, and a piston 83. The whipstock 37 is a long steel casing disposed downhole and designed to deflect a mill bit 11 from the wellbore 3 with a deflection surface 39. The deflection surface 39 is a tapered, concave shaped bar located towards an upper end of the whipstock 37 that is used to deflect the mill bit 11 to alter the trajectory of the mill bit 11. The anchor connection 49 is commonly a hinge system design that connects the whipstock 37 to the whipstock anchor 79. The whipstock anchor 79, typically formed of high-strength alloy steel, secures the whipstock assembly 57 in the wellbore 3 by digging into the casing 33 when set. The whipstock packer 81 is often formed of elastomeric materials and acts as a seal, preventing any fluid from passing through it. The piston 83 of the whipstock assembly 57, composed of steel, is designed to set the whipstock anchor 79 and whipstock packer 81 subsequent to a pressure reaction acting on the piston 83 created within the bypass valve mechanism 59.

Figure 6:
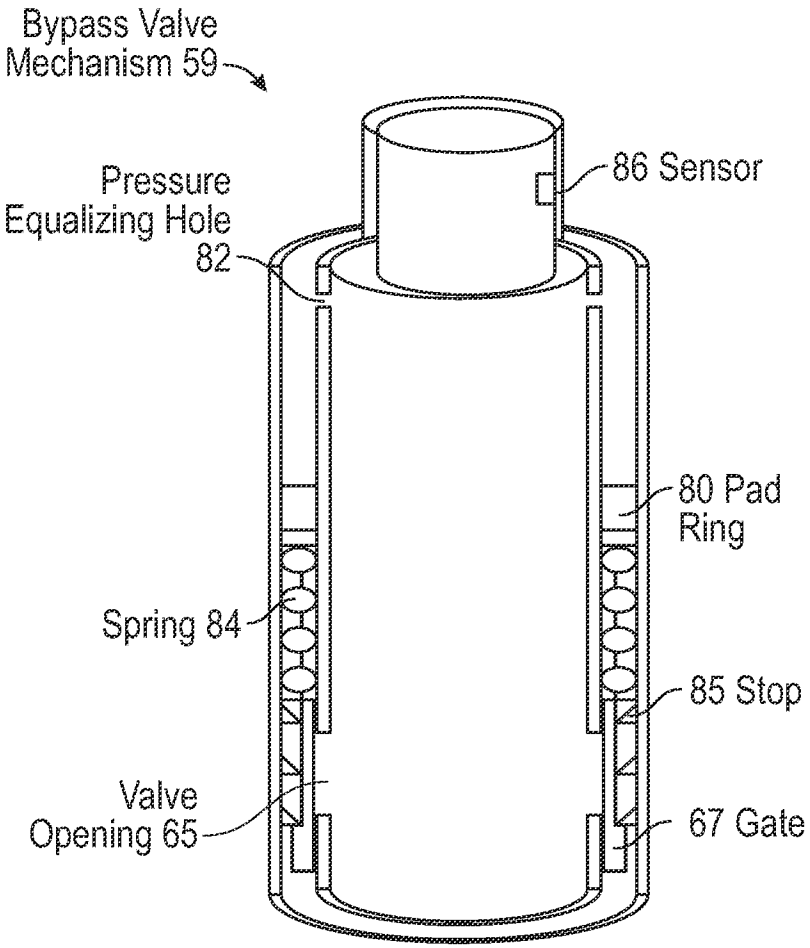
FIGS. 5 and 6 show a bypass valve mechanism with a gate in an open position and closed position, respectively, in accordance with one or more embodiments of the present disclosure.
Figure 5:
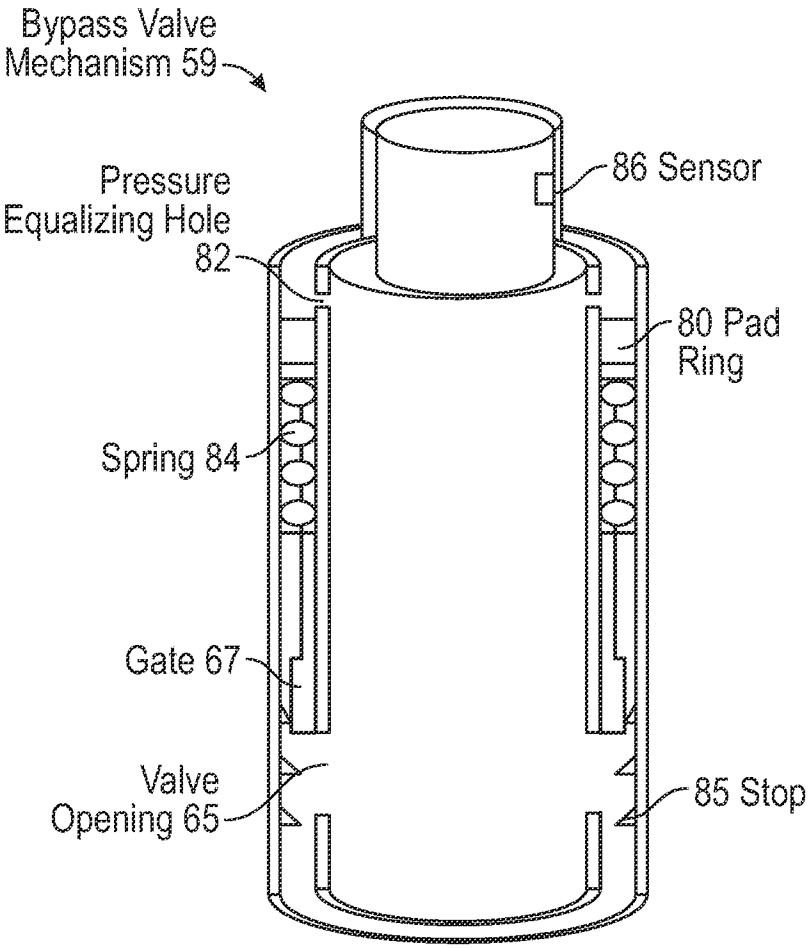

FIGS. 5 and 6 provide an overview of an operational sequence of closing the gate 67 of the bypass valve mechanism 59, in accordance with one or more embodiments. As shown in FIG. 5, the bypass mechanism 59 includes a sensor 86, pressure equalizing holes 82, and a gate assembly formed by a gate 67, a spring 84, and a pad ring 80 that are actuated to abut the gate 67 against a stop 85, thereby closing the valve opening 65. The sensor 86, a pressure sensor in communication with an operator located at the surface 31, is disposed at the upper end of the bypass valve mechanism 59 or attached to the bypass valve mechanism 59 as part of the upper whipstock assembly. The pad ring 80 is disposed on top of the spring 84 and forms a seal that allows fluid pressure to build on the upper surface of the pad ring 80. As shown in FIG. 5 the pad ring 80 is rigidly fixed to the spring 84, which is, in turn, rigidly fixed to the gate 67. Furthermore, each of the pad ring 80, the stop 85, and the gate 67 are disposed in a space between an interior and exterior wall of the bypass valve mechanism 59, which prevents lateral movement of the components.

The bypass valve mechanism 59 is depicted with the gate 67 in the open position in FIG. 5. When the bypass valve mechanism 59 is installed downhole in the wellbore 3 with the whipstock assembly 57, the gate 67 is positioned in the open position, disposed above the plurality of valve openings 65. The gate 67 is held in this position by a spring 84 and the stop 85. As such, while the gate 67 abuts against the upper end of the stop 85, the valve openings 65 are open. Conversely, as shown in FIG. 6, when the gate 67 is in the closed position, the gate 67 abuts against the bottom of the stop 85 such that the valve openings 65 are closed. In both the closed and open gate 67 positions, the spring 84 remains at rest and is not required to be in tension or compression in either position. Rather, the spring 84 is only compressed during the actuation of the gate 67.

Actuation of the gate 67 is driven by fluid pressure acting on the combination of the pressure equalizing holes 82, the spring 84, the sensor 86, and the pad ring 80. As noted above, the gate 67 is initially in an open position, allowing fluid communication to the remainder of the milling assembly through the valve opening 65. However, once an obstruction is cleared and the milling operation is no longer necessary, the gate 67 is closed to prevent fluid waste. In such instances, an operator at the surface of the wellbore increases the fluid pressure in the drill string, thereby creating fluid backflow that enters the pressure equalizing holes 82. This backflow acts on the top of the pad ring 80, which compresses the spring 84. The compressed spring 84 passively transmits the backflow pressure to the gate 67 which causes the gate 67 to be actuated against and through the stop 85, at which point the spring 84 is no longer compressed. As shown in FIG. 5, the stop 85 is formed as a series of gripping ledges that elastically deform to provide frictional interference between the gate 67 and the interior wall of the bypass valve mechanism 59. The stop 85 may be formed of rubber, nitrile, or other gripping materials commonly known in the art.

Accordingly, the actuation of the gate 67 depends upon the size of the pressure equalizing holes 82, the size of the valve opening 65, the amount of resistance provided by the stop 85, the surface area of the pad ring 80, and the spring constant of the spring 84, each of which are determined according to the potential backflow pressure that can be developed to ensure proper actuation of the gate 67. By way of example, for a given fluid pressure and a known dimension of the valve opening 65, the size and structure of the pad ring 80, the stop 85, the pressure equalizing holes 82, and spring 84 may be adjusted such that the backpressure created by increasing the pressure of the fluid above the given fluid pressure is sufficient to actuate the gate 67.

Because the stop 85 is embodied as a series of gripping ledges, it is further envisioned that cyclic backpressure forces the gate 67 to actuate over only one ledge per backpressure cycle such that the full actuation of the gate 67 depends on the duration or number of cycles of pressure applied to the pad ring 80. Specifically, when the operator increases the flow rate of a mud pump, the resultant increase in fluid pressure creates the requisite backflow and the gate 67 is actuated through one of the ledges of the stop 85, thereby changing the size of the valve opening 65. This change in sizing causes a pressure buildup within the bypass valve mechanism 59 and reduces the amount of fluid entering the remainder of the whipstock assembly.

The change of fluid pressure in the bypass valve mechanism 59 is conveyed to an operator through the sensor 86. Upon receiving information that the gate 67 has moved through the first ledge of the stop 85, the operator continues the operation by raising the pressure again (to actuate the gate 67 through a subsequent ledge) or retaining the same pressure, in which case the gate 67 remains in position. Thus, the number of ledges of the stop 85 determines the number of pressure cycles required to actuate the gate 67. By way of nonlimiting example, and as shown in FIGS. 5 and 6, the number of ledges may be three or more.

While the above description is directed towards an operator monitoring the pressure drop in cycles to actuate the gate 67 through each individual ledge of the stop 85, it is contemplated that the operator may actuate the gate 67 through every ledge of the stop 85 without waiting to monitor a pressure change in the bypass valve mechanism 59. In this case, a prerequisite pressure is established that is greater than initial pressure and the pressure differential created by changing the size of the valve openings 65. During operation, when an operator wishes to actuate the gate 67 such that the gate 67 is actuated through every ledge of the stop 85 without adjustment, the operator adjusts the backpressure of the system to match the prerequisite pressure. As a result, the backpressure developed in the bypass valve mechanism 59 overcomes the initial pressure and the pressure differential(s) created by changing the size of the valve openings 65 to such a degree that the gate 67 is actuated through each ledge of the stop 85 without delay.

Figure 7:
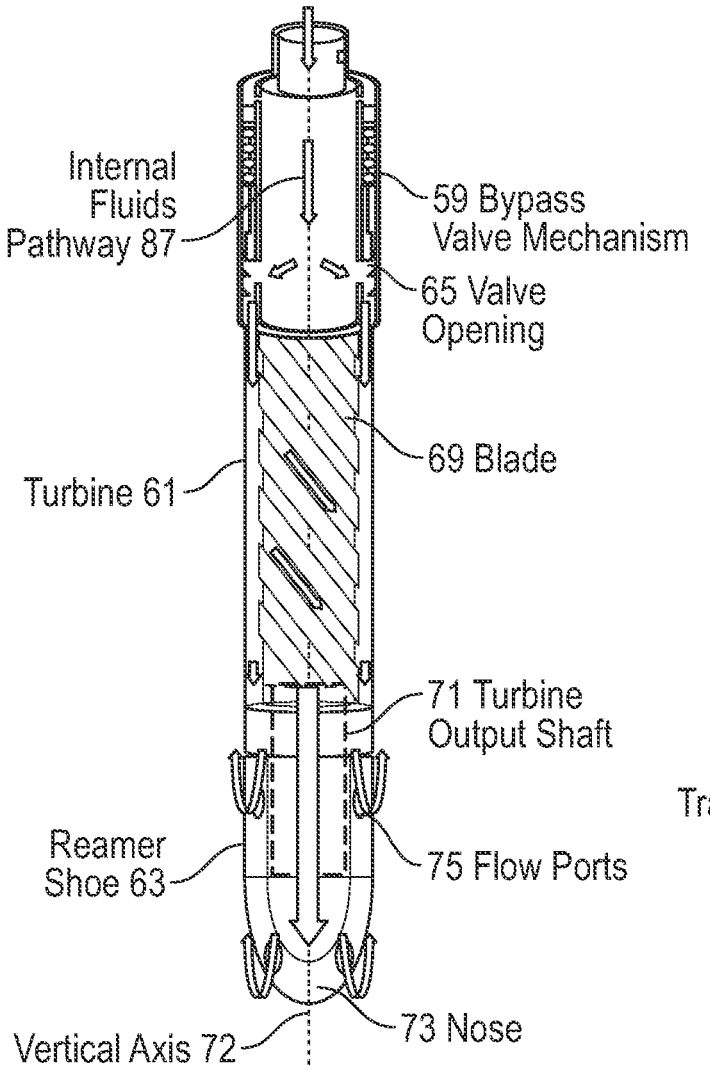
FIG. 7 shows a lower portion of the whipstock assembly in accordance with one or more embodiments of the present disclosure.

FIG. 7 illustrates the internal fluids pathway 87 through the lower portion of the whipstock assembly 57 in accordance with one or more embodiments. In this figure, the gate 67 of the bypass valve mechanism 59 is in the open position. The fluid enters the turbine 61 after exiting the bypass valve mechanism 59 through the plurality of valve openings 65 in a space between the interior and exterior wall of the bypass valve mechanism 59. In the turbine 61, the fluid flows over the helically shaped blade 69, applies pressure on the blade 69, and subsequently causes the turbine 61 to rotate. The fluid is then forced to flow through an opening in the bottom end of the turbine 61 and into the opening situated at the top end of the reamer shoe 63. The reamer shoe 63 includes a plurality of flow ports 75 that the fluid passes through, thereby exiting the whipstock assembly 57 and entering the wellbore 3. The fluid exits with enough pressure to assist in clearing debris 89 dislodged while the reaming shoe reams the obstruction 77 and returns to the surface 31 in the annular space between the turbine 61 and the wellbore 3 with the debris 89 entrained therein.

The inner and outer diameters of the turbine 61 are determined according to the size of the whipstock. By way of nonlimiting example only, for a 9⅝ inch diameter whipstock, the turbine 61 has a maximum outer diameter of 7 inches and minimum inner diameter of 5 inches. Similarly, by way of nonlimiting example, for a 7 inch diameter whipstock, the turbine 61 is has a maximum outer diameter of 3¾ inches and minimum inner diameter of 1¾ inches.

Figure 8:
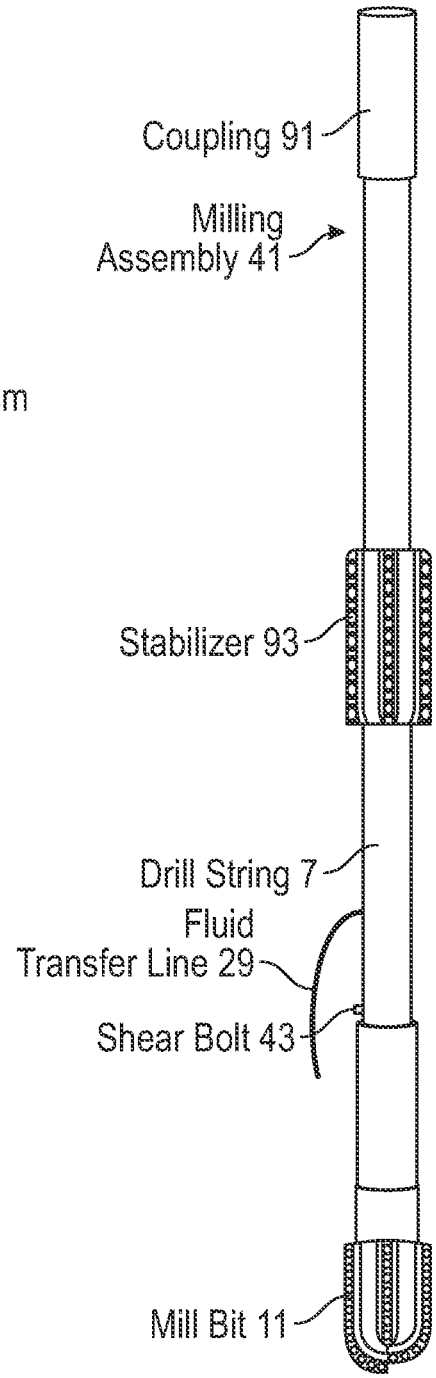
FIG. 8 shows a milling assembly in accordance with one or more embodiments of the present disclosure.

FIG. 8 shows the milling assembly 41 according to one or more embodiments. The milling assembly 41 includes the drill string 7, a coupling 91, a mill bit 11, a stabilizer 93, a fluid transfer line 29, and a temporary connection to the whipstock assembly 57. The coupling 91 is designed to couple pieces of the drill string 7 together to form a longer conduit and is formed of steel. The mill bit 11 is disposed at the bottom end of the milling assembly 41 and is temporarily attached to the whipstock assembly 57 prior to the whipstock assembly 57 setting. Once detached from the whipstock assembly 57, the mill bit 11 mills through the casing 33 of the wellbore 3 and creates a new wellbore 45 parallel to the deflection surface 39 of the whipstock assembly 57 by milling through the formation 5. While milling, the stabilizer 93, disposed on the drill string 7 above the mill bit 11, minimizes torque and drag on the drill string 7 and reduces damage to a wall of the new wellbore 45. The stabilizer 93 is constructed of multiple spiral ribs formed of high-strength alloy steel. The milling assembly 41 is temporarily attached to the whipstock assembly 57 prior to the setting of the whipstock 37 by a shear bolt 43, magnetic interlock, or other equivalent connection. The shear bolt 43, magnetic interlock, or other equivalent connection is disposed above the mill bit 11 on the drill string 7 of the milling assembly 41.

Figure 9:
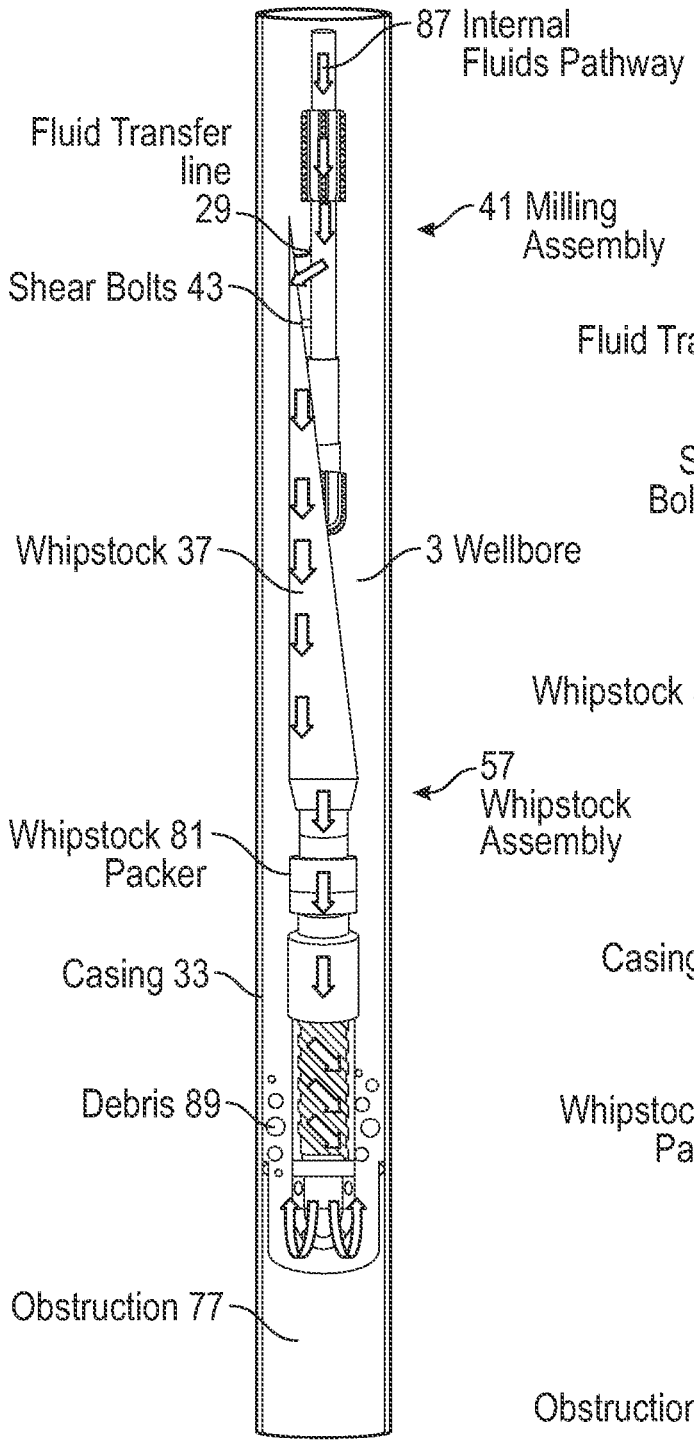
FIGS. 9-11 show diagrams depicting an operational sequence of the system in accordance with one or more embodiments of the present disclosure.
Figure 10:
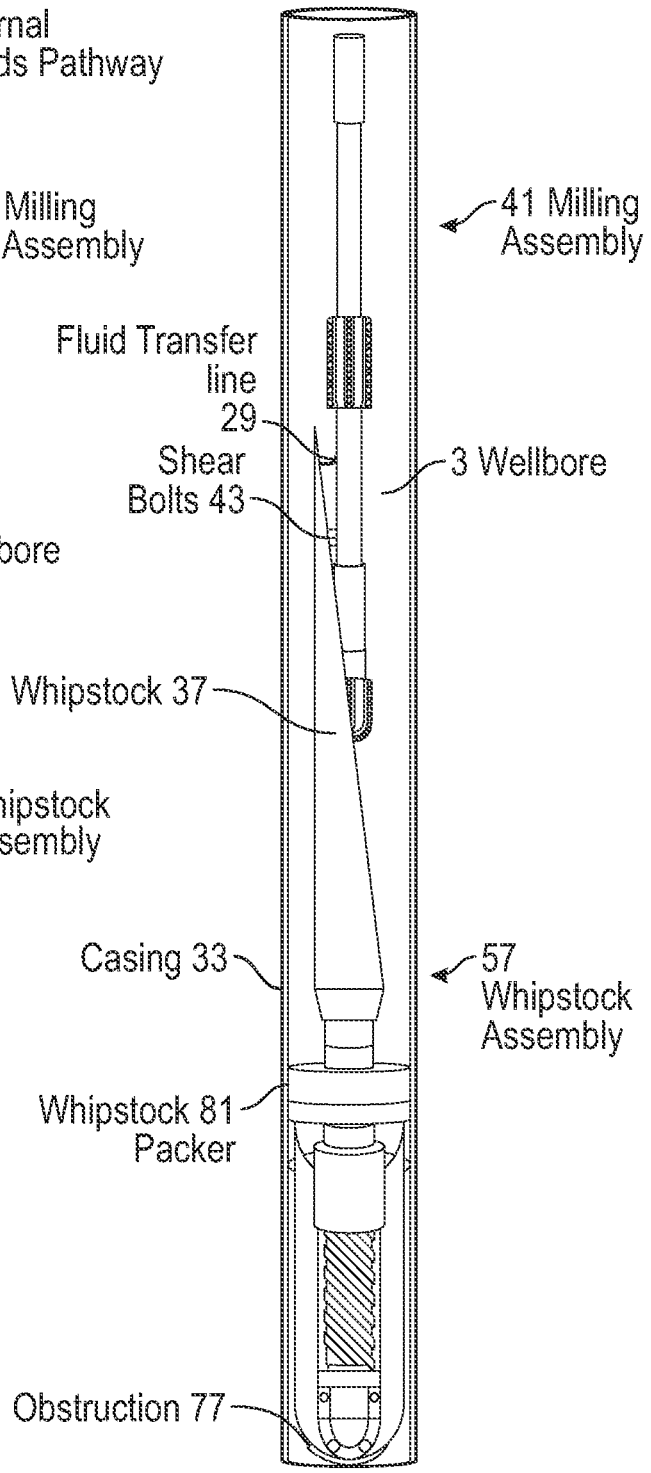
Figure 11:
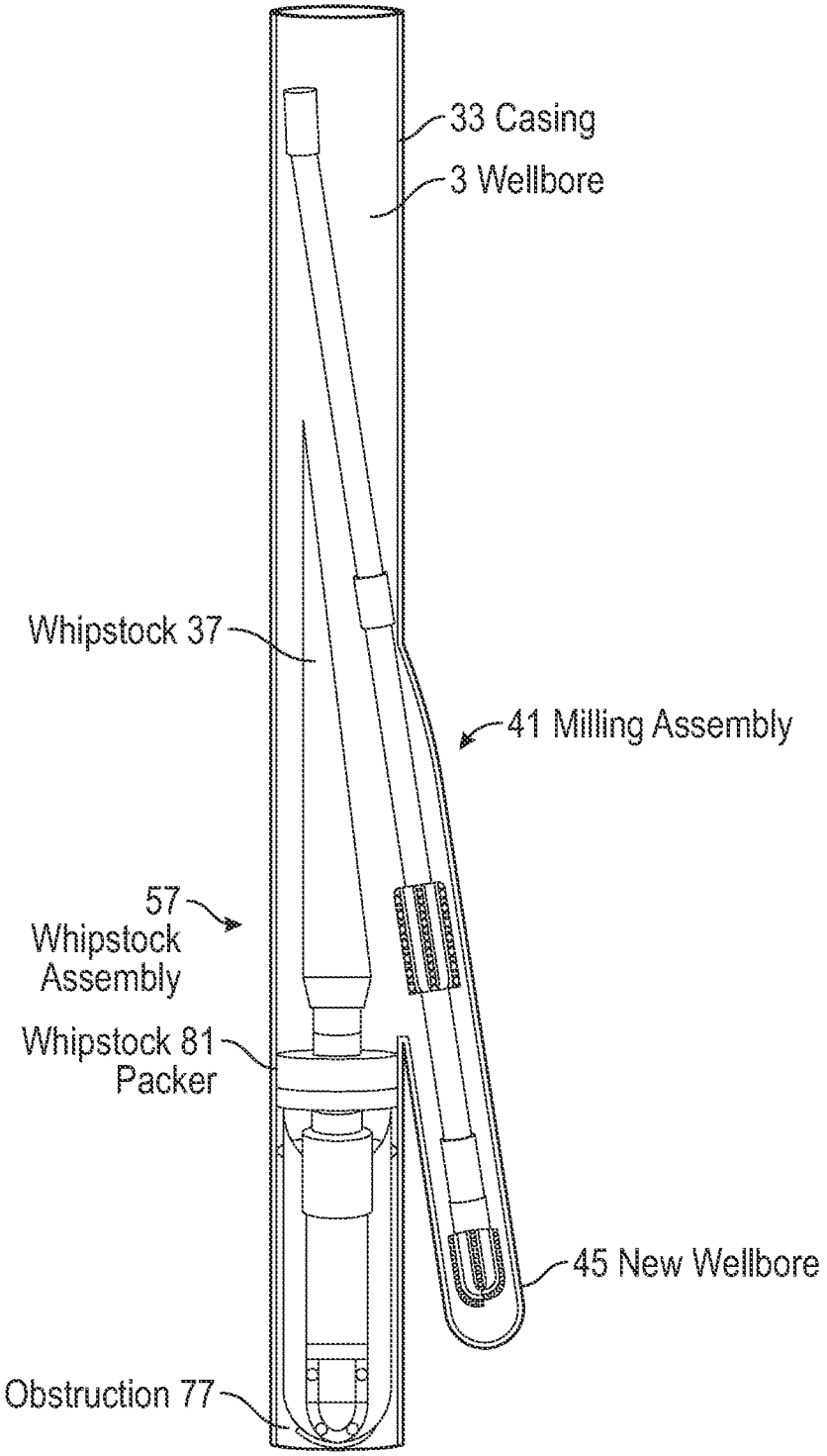

FIGS. 9-11 provide an overview of an operational sequence of reaming an obstruction 77, setting the whipstock assembly 57, and milling the new wellbore 45 according to one or more embodiments disclosed herein.

FIG. 9 illustrates the whipstock assembly 57 reaming through the obstruction 77 in the wellbore 3. The fluid is pumped into the drill string 7 from the surface 31 and flows from the milling assembly 41 to the whipstock assembly 57. Specifically, the fluid exits the milling assembly 41 through the fluid transfer line 29 and enters the whipstock assembly 57 through an opening (not shown) in the upper end of the whipstock 37. As the fluid is transported through the whipstock assembly 57, power is generated by the fluid flowing through the turbine 61, thereby rotationally actuating the reamer shoe 63. The reamer shoe 63 begins to ream the obstruction 77 in the wellbore 3 through the use of its nose 73. The nose 73 is convex shaped blade formed of PDC or a similarly strong material that is capable of breaking and clearing an obstruction 77. The fluid exits the reamer shoe 63 through the flow ports 75 disposed in the nose 73 of the reamer shoe 63 and enters the wellbore 3. In the wellbore 3, the fluid flows back up to the surface 31 carrying the debris 89 of the reamed obstruction 77. The fluid will continue to be pumped into the system, causing the reamer shoe 63 to ream the obstruction 77, until a desired depth is reached.

As shown in FIG. 9, the milling assembly 41 is fluidly connected to the whipstock 37 by a fluid transfer line 29 that transfers fluid therebetween. The fluid transfer line 29 is connected to both the milling assembly 41 and the whipstock 37 using a connection with an auto shutoff feature, such as a quick disconnect with a gate, that closes the connection when the fluid transfer line 29 is not connected to either the milling assembly or the whipstock assembly. As such, when the milling assembly 41 moves away from the whipstock 37 after the whipstock 37 is set in the wellbore, the fluid transfer line 29 is pulled out of the milling assembly 41 or the whipstock 37, efficiently severing the fluid connection thereof while preventing fluid leakage.

FIG. 10 depicts the system subsequent to the whipstock assembly 57 being set in accordance with one or more embodiments of the present invention. Following the desired depth being reached by the reamer shoe 63, the gate 67 of the bypass valve mechanism 59 is closed. Therefore, fluid can no longer pass through the lower portion of the whipstock assembly 57. With the gate 67 closed, and the reamer shoe 63 no longer rotating, the whipstock assembly 57 sets. This is achieved by the whipstock anchor 79 digging into the casing 33 of the wellbore 3 and the whipstock packer 81 expanding until the wellbore 3 is sealed.

FIG. 11 shows the system subsequent to the milling assembly 41 milling the new wellbore 45 according to one or more embodiments of the present invention. After the whipstock assembly 57 is set, a downward force is applied to the drill string 7 from the surface 31, thereby shearing the shear bolt 43 that connected the milling assembly 41 to the whipstock assembly 57. The milling assembly 41 is then free to begin milling and is guided by the deflection surface 39 of the whipstock 37. The milling assembly 41 mills through the casing 33 of the wellbore 3 and into the formation 5 creating the new wellbore 45 parallel to the deflection surface 39 until a new desired depth is reached. The new wellbore 45 is formed at an angle to the wellbore 3 in order to avoid subsurface hazards, reuse of an existing wellbore 3 that has depleted reservoir production, or for a number of reasons that are not specifically described but would be understood to a person skilled in the art.

Figure 12:
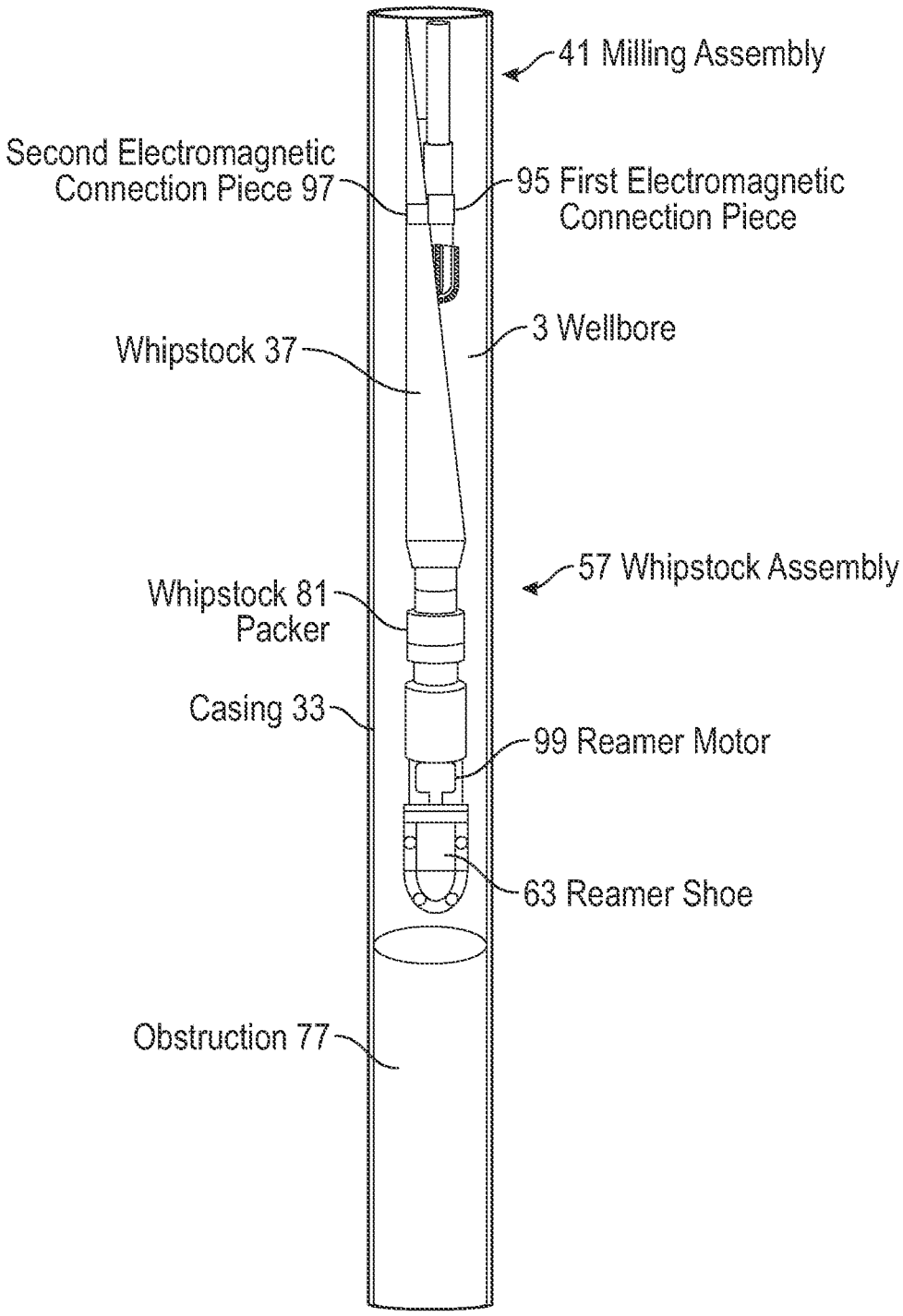
FIG. 12 shows a system in accordance with one or more embodiments of the present disclosure.

FIG. 12 depicts another embodiment of the system including the milling assembly 41 and the whipstock assembly 57 being ran downhole in the wellbore 3 until an obstruction 77 is met. In this embodiment, the milling assembly 41 and whipstock assembly 57 are temporarily connected by an electromagnetic connection. The electromagnetic connection is utilized to connect the two assemblies until the whipstock assembly 57 is set and a downward force on the milling assembly 41 forces the electromagnetic connection to break. Subsequent to the electromagnetic connection breaking, the milling assembly 41 is forced downwards along the whipstock 37 in the direction of a new wellbore 45. A first electromagnetic connection piece 95 is disposed on the drill string 7 of the milling assembly 41 above the mill bit 11 and may be an electromagnetically charged collar or rod. On the whipstock assembly 57, a second electromagnetic connection piece 97 is disposed at an upper end of the whipstock 37 and may be an electromagnetically charged strip or collar.

After the completion of milling the new wellbore 45, the milling assembly 41 is lifted back towards the whipstock 37. The milling assembly 41 and whipstock assembly 57 reconnect via the electromagnet connection once the first electromagnetic connection piece 95 and second electromagnetic connection piece 97 come into contact, thereby permitting the two assemblies to be extracted from the well together. Alternatively, if the milling assembly 41 mills towards an unexpected hazard or an additional obstruction 77, the milling assembly 41 can be retracted to reattach to the whipstock 37. In this instance, the whipstock assembly 57 can ream further through the obstruction 77 in the wellbore 3 until it is believed the milling assembly 41 can mill into the formation 5 without meeting another hazard or obstruction 77. Further, in this alternative embodiment, the reamer shoe 63 is rotationally actuated by a battery powered reamer motor 99 that can be controlled from the surface 31.

Figure 13:
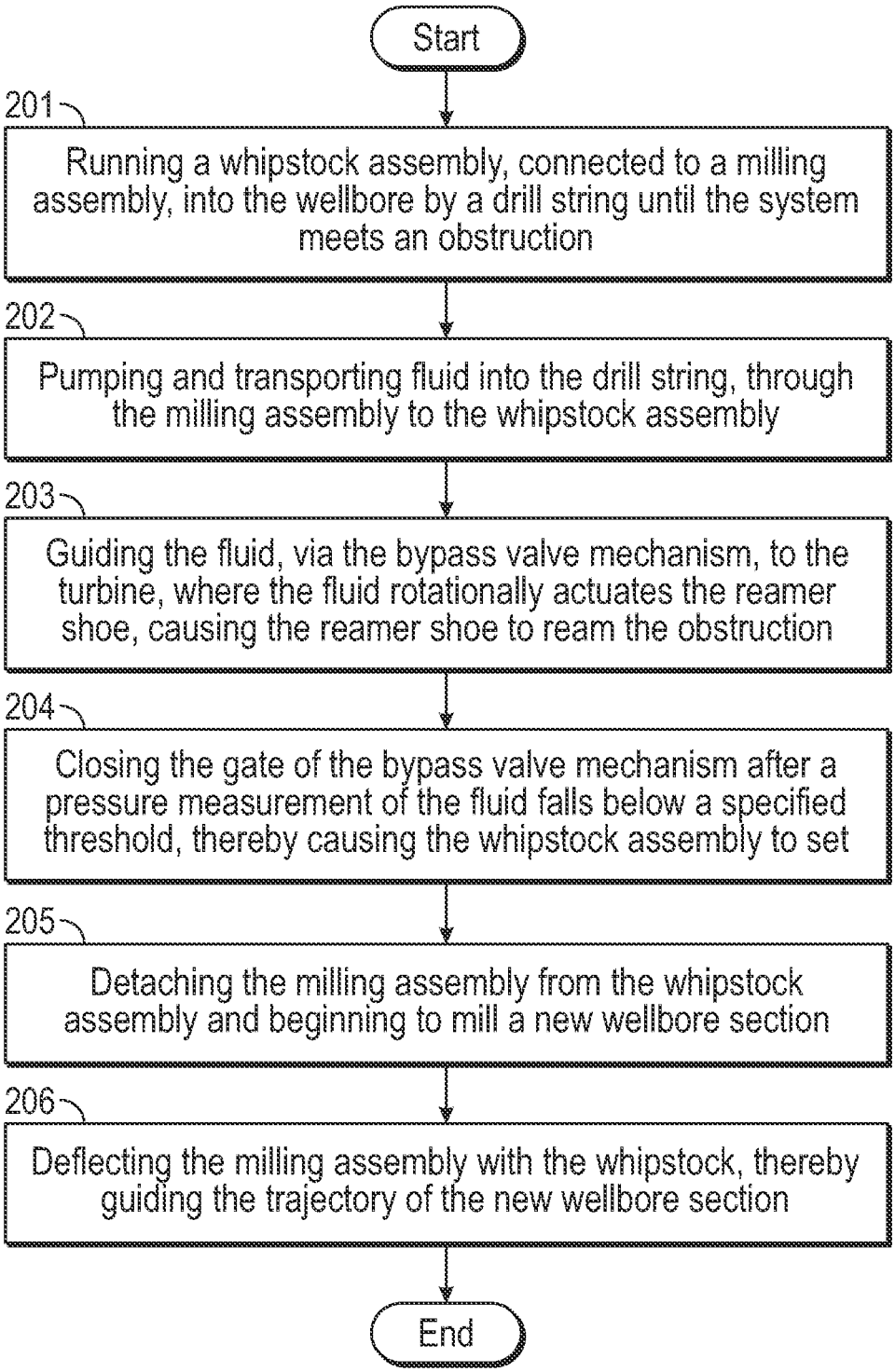
FIG. 13 shows a flowchart of a method in accordance with one or more embodiments of the present disclosure.

FIG. 13 depicts a flowchart showing a method of reaming an obstruction 77 in a wellbore and milling a new wellbore 45 section under the control of a bypass valve mechanism 59. While the various flowchart blocks in FIG. 13 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In block 201, the whipstock assembly 57, connected to the milling assembly 41, is run into the wellbore 3. The two assemblies are connected to each other by the shear bolt 43 and are lowered in the wellbore 3 until the whipstock assembly 57 meets an obstruction 77. If no obstruction is met, the whipstock assembly is set at the desired depth.

In block 202, the fluid is pumped into the drill string 7 of the milling assembly 41 from the surface 31. The fluid is transported from the milling assembly 41 to the whipstock assembly 57. Specifically, the fluid transfer line 29 transports the fluid out of the milling assembly 41 and into the opening of the upper end of the whipstock 37. The fluid continues to flow downward through the whipstock 37 and into the bypass valve mechanism 59. The gate 67 of the bypass valve mechanism 59 is in the open position until the whipstock 37 is set, thereby facilitating the passage of fluid through the plurality of valve openings 65 of the bypass valve mechanism 59.

In block 203, the fluid flows from the bypass valve mechanism 59 into the turbine 61 by passing through the plurality of valve openings 65. This is facilitated by the gate 67 being in the open position. As the fluid flows through the turbine 61, the fluid applies force on the blade 69 of the turbine 61, thereby rotationally actuating the turbine 61, and thus, the turbine output shaft 71 and the reamer shoe 63. The power generated by the fluid flowing through the turbine 61 is enough to force the reamer shoe 63 to ream through the obstruction 77. While the reamer shoe 63 is reaming the obstruction 77, fluid exits the reamer shoe 63 through the plurality of flow ports 75 and enters the wellbore 3. From the wellbore 3, the fluid flows back up to the surface 31. In addition, the fluid lifts the debris 89 from the reamed obstruction 77 to the surface 31. The reamer shoe 63 continues to ream the obstruction 77 until the desired depth is reached.

In block 204, subsequent to the desired depth being reached by the reamer shoe 63, a variable control pressure nozzle reduces the pressure of the fluid. When the pressure measurement of the fluid falls below the specified requirement, the gate 67 of the bypass valve mechanism 59 closes the plurality of valve openings 65. This, in turn, creates a pressure reaction on the piston 83 of the whipstock assembly 57, thereby setting the whipstock anchor 79 and expanding the whipstock packer 81. As the whipstock anchor 79 sets, it digs into the casing 33 of the wellbore 3 until the whipstock assembly 57 is secured.

In block 205, subsequent to the whipstock assembly 57 setting in the wellbore 3, a downward force is applied onto the milling assembly 41 from the surface 31. The force is great enough to detach the milling assembly 41 from the whipstock assembly 57 by shearing the shear bolt 43 temporarily holding the two assemblies together. Once detached, the milling assembly 41 retracts upwards in the wellbore 3, away from the whipstock assembly 57, and begins to rotate the mill bit 11. Once the mill bit 11 begins to rotate, the milling assembly 41 is lowered back down to create a new wellbore 45.

In block 206, as the milling assembly 41 is lowered, the deflection surface 39 of the whipstock assembly alters the trajectory of the milling assembly 41, guiding it at an angle away from the wellbore 3. The mill bit 11 is designed to mill through the casing 33 and creates a new wellbore 45 section external to the wellbore 3.

Accordingly, the aforementioned embodiments as disclosed relate to devices and methods useful for both reaming an obstruction 77 in a wellbore and milling a new wellbore 45 under the control of a bypass valve mechanism 59.

The disclosed system for and methods of reaming an obstruction 77 in a wellbore and milling a new wellbore 45 under the control of a bypass valve mechanism 59 advantageously run the whipstock 37 safely to the desired depth without any additional cleanout trips. This benefit, in turn, advantageously reduces additional rig time and associated costs. Furthermore, the ability of the disclosed system and methods to ream any obstruction 77 while being deployed to a specified depth advantageously reduces the chances of the system getting stuck.

Although only a few embodiments of the invention have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A system comprising:

a milling assembly comprising a mill bit and a drill string configured to mill a new wellbore section; and a whipstock assembly comprising:

a reamer shoe configured to ream an obstruction in a wellbore;

a whipstock configured to deflect the milling assembly away from the wellbore; and a bypass valve mechanism configured to regulate a fluid flowing from the whipstock to the reamer shoe, the bypass valve mechanism comprising:

a gate;

a spring; and a plurality of valve openings;

wherein the milling assembly is fluidly connected to the whipstock assembly; and wherein the gate of the bypass valve mechanism is configured to close the plurality of valve openings when a force caused by a pressure change of the fluid is applied on the spring.

2. The system according to claim 1, wherein the whipstock assembly comprises a turbine configured to rotationally actuate in response to the fluid flowing from the bypass valve mechanism to the reamer shoe.

3. The system according to claim 2, wherein the turbine is embodied as a helically shaped blade.

4. The system according to claim 2, wherein the turbine is directly connected to the reamer shoe by a turbine output shaft.

5. The system according to claim 4, wherein the bypass valve mechanism, the turbine, the turbine output shaft, and the reamer shoe are sequentially aligned on a same vertical axis.

6. The system according to claim 1, wherein the reamer shoe comprises a plurality of flow ports configured to facilitate the fluid exiting the system into the wellbore.

7. The system according to claim 6, wherein the reamer shoe further comprises a convex shaped nose configured to enable ledge-riding.

8. The system according to claim 1, wherein the whipstock assembly further comprises:

a whipstock anchor;

a whipstock packer; and an anchor connection configured to connect the whipstock and the whipstock anchor.

9. The system according to claim 8, wherein the whipstock anchor is fluidly connected to the bypass valve mechanism.

10. A method comprising:

running a whipstock assembly fluidly connected to a milling assembly into a wellbore to a desired depth;

regulating, by a bypass valve mechanism of the whipstock assembly, a fluid flowing through the whipstock assembly, the bypass valve mechanism comprising:

a gate;

a spring; and a plurality of valve openings;

reaming, by a reamer shoe of a whipstock assembly, an obstruction in the wellbore;

closing, by the gate of the bypass valve mechanism, the plurality of valve openings when a force caused by a pressure change of the fluid is applied on the spring;

deflecting, by a whipstock of the whipstock assembly, the milling assembly away from the wellbore; and milling, by a mill bit of the milling assembly, a new wellbore section away from the wellbore.

11. The method according to claim 10, further comprising transporting the fluid from a surface of the wellbore to a plurality of flow ports of the reamer shoe by a drill string.

12. The method according to claim 11, further comprising controlling a pressure in the bypass valve mechanism by a variable pressure control nozzle.

13. The method according to claim 12, wherein regulating the fluid flowing through the whipstock assembly further comprises transporting the fluid through the plurality of valve openings to a turbine when a pressure measurement of the fluid is above a specified threshold.

14. The method according to claim 13, further comprising rotationally actuating the reamer shoe via fluid flowing from the bypass valve mechanism to the reamer shoe.

15. The method according to claim 14, wherein, subsequent to passing through the turbine, the fluid exits the whipstock assembly through the plurality of flow ports disposed in the reamer shoe.

16. The method according to claim 13, further comprising lowering the gate to close the plurality of valve openings of the bypass valve mechanism when the pressure measurement of the fluid is below a specified requirement.

17. The method according to claim 16, further comprising creating a pressure reaction on a piston of a whipstock anchor and a whipstock packer of the whipstock assembly by closing the gate of the bypass valve mechanism, thereby setting the whipstock assembly in the wellbore.

18. The method according to claim 17, wherein setting the whipstock assembly further comprises anchoring the whipstock assembly in the wellbore with the whipstock anchor and expanding the whipstock packer to seal the wellbore.

19. The method according to claim 18, further comprising milling the new wellbore section subsequent to setting the whipstock assembly, detaching the milling assembly from the whipstock assembly, and deflecting the milling assembly from a deflection surface of the whipstock.

* * * * *